US007469489B2

(12) United States Patent
Lewin

(10) Patent No.: US 7,469,489 B2
(45) Date of Patent: Dec. 30, 2008

(54) METHOD GAS BURNER AND A COMBINED GAS BURNER AND COOLER WITH GAS INSULATION

(75) Inventor: Thomas Lewin, Hallstahammar (SE)

(73) Assignee: Sandvik Intellectual Property AB, Sandviken (SE)

( * ) Notice: Subject to any disclaimer, the term of this patent is extended or adjusted under 35 U.S.C. 154(b) by 565 days.

(21) Appl. No.: 10/540,678

(22) PCT Filed: Dec. 4, 2003

(86) PCT No.: PCT/SE03/01887

§ 371 (c)(1),
(2), (4) Date: Feb. 18, 2006

(87) PCT Pub. No.: WO2004/057234

PCT Pub. Date: Jul. 8, 2004

(65) Prior Publication Data

US 2007/0042304 A1 Feb. 22, 2007

(30) Foreign Application Priority Data

Dec. 23, 2002 (SE) ..... 0203845

(51) Int. Cl.
*F26B 5/04* (2006.01)

(52) U.S. Cl. ..... 34/380; 34/90; 431/160

(58) Field of Classification Search ..... 34/380, 34/90; 431/160

See application file for complete search history.

(56) References Cited

U.S. PATENT DOCUMENTS

| | | | | |
|---|---|---|---|---|
| 1,408,457 | A * | 3/1922 | Harrison | 34/475 |
| 3,174,474 | A | 3/1965 | Jones et al. | 126/91 A |
| 3,724,447 | A | 4/1973 | Parkhill et al. | 266/200 |
| 4,624,059 | A * | 11/1986 | Hammarskog et al. | 34/435 |
| 5,649,992 | A * | 7/1997 | Carter et al. | 75/10.14 |
| 5,932,885 | A | 8/1999 | DeBellis et al. | 250/493.1 |

FOREIGN PATENT DOCUMENTS

GB 907504 10/1962

* cited by examiner

*Primary Examiner*—S. Gravini
(74) *Attorney, Agent, or Firm*—Alfred J. Mangels

(57) ABSTRACT

The present invention relates to a method relating to the operation of a burner and/or cooler (3), wherein gases are caused to flow through an inner pipe (7), out into an outer pipe (5) which surrounds the inner pipe (7), and back through that part of the volume of the outer pipe (5) not accommodated by the volume of the inner pipe (7). The invention is characterised by placing an inner bottom plates (8) in the outer pipe (5) in spaced relationship with the closed bottom (9) of said outer pipe (5), whereby the gases flowing through the inner pipe (7) and out into the outer pipe (5) are caused to turn back and pass between the outer pipe (5) and the inner pipe (7), thereby creating a gas pocket (12) between the bottom (9) of said outer pipe (5) and the bottom plate (8).

14 Claims, 2 Drawing Sheets

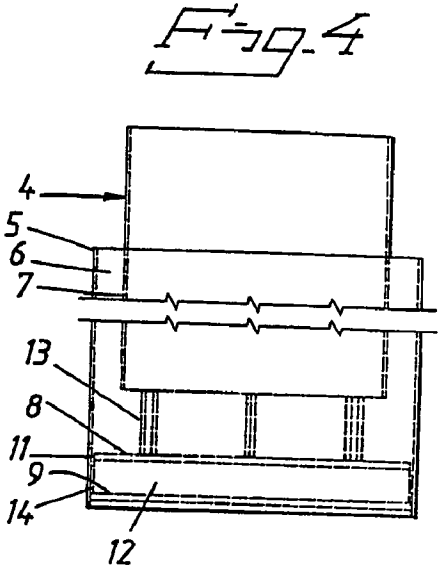
FIG-4
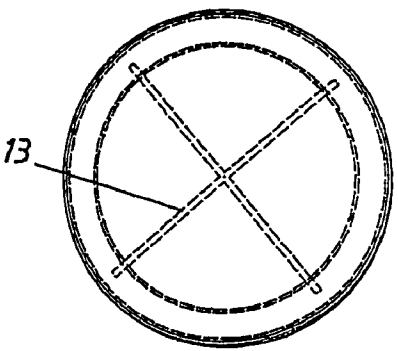
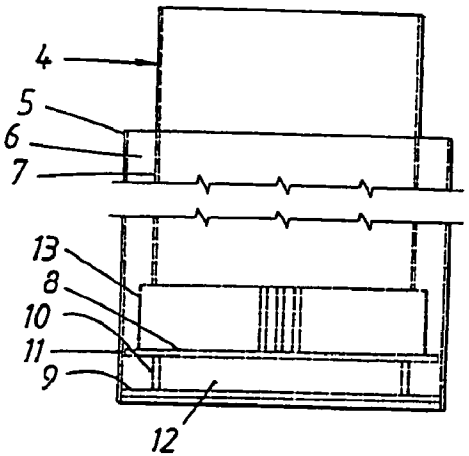
FIG-3
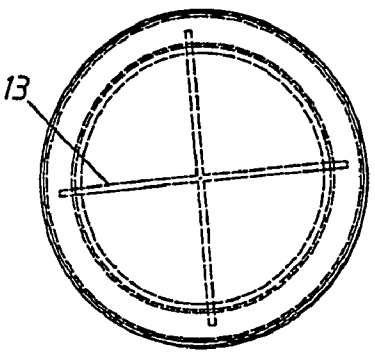

METHOD GAS BURNER AND A COMBINED GAS BURNER AND COOLER WITH GAS INSULATION

BACKGROUND OF THE INVENTION

1. Field of the Invention

The present invention relates to a method pertaining to a burner and to a burner-cooler combination.

More specifically, the invention relates to a method of reducing material wear in the operation of furnace-heating burners. The burner concerned may be a gas burner, an oil burner, or a solid fuel burner.

The invention is exemplified below with reference to a combined gas burner and cooler.

2. Description of the Related Art

Furnaces are often heated with the aid of a gas burner. This burner will typically consist of a gas source from which gas is led through a nozzle and then ignited to provide a flame. The extremely hot gases of combustion are led through an open-bottom inner pipe. The inner pipe is surrounded by a closed-bottom outer pipe so as to form a closed pipe system. The waste gases are led out through the upper part of the outer pipe. The pipe system is situated in the heated furnace volume and there contributes to the heating process by transferring the heat generated by combustion to the heated volume of the furnace, primarily by thermal radiation.

Because the internal volume of the pipe system is not in contact with the heated furnace volume, the combusted gas or its combustion products will never come into contact with the products to be heated in the furnace.

A temperature of 500-1100° C. is a typical working temperature of such a furnace.

When the product heated in the furnace is ready to be removed therefrom, it will, of course, take a considerable length of time for the furnace, its heated volume, and the heated product to cool down to a temperature at which they can be handled without the aid of special tools. In order to hasten the furnace cooling process, cold air is often pumped into the inner pipe so as to cool down the heated furnace volume actively, by transferring the heat stored in the heated furnace volume to the cold air via the outer pipe.

In this type of operation, the outer pipe of the gas burner is named a "cooling finger." The cooling air is thus led through the same pipe system as that in which the gas burner is included while the gas and fuel supply is switched off during this process, and there is opened instead an air supply source from which cooling air flows through the pipe system. The cooling air flow will often have a very large volume. For instance, the volume of cooling air used when cooling the furnace is typically 100 $m^3/h$.

At times, the arrangement is used solely as a cooling finger.

Since the temperature of the cooling air is, of course, much lower than the temperature of the atmosphere in the heated furnace volume, and since the cooling air does not communicate directly with said atmosphere, those parts of the pipe system that constitute the barrier between the cooling air and the heated furnace volume will be subjected to strong material stresses. These stresses are sufficiently powerful to cause significant mechanical stresses in the joints between the different parts of the pipe system constituting said barrier.

In the case of known techniques, the cooling air is led through the inner pipe that opens into the outer pipe which is in direct contact with the enclosed furnace volume and through which the cooling air further passes and exits from the pipe system. In the region where the cooling air exits from the inner pipe and turns and flows back through that part of the outer pipe volume that is not accommodated by the inner pipe volume, the cooling effect is relatively strong. Consequently, the stresses on the material resulting from the powerful temperature gradients that occur in the outer pipe material will be significant in this region, the bottom construction of the outer pipe being particularly subjected to such stresses. The bottom construction will often consist of a bottom plate which is firmly fixed mechanically to the outer pipe. Material wear in the joints between said bottom plate and the barrel surface of the outer pipe will be significant regardless of how the bottom plate is secured, i.e., by welding, screwing, etc., such wear also being caused by cyclically varying loads which lead to thermal fatigue.

Other solutions to these problems have been proposed. For instance, one solution proposes that the outer bottom plate is given a curved shape so as to accommodate more effectively those material stresses that are applied to the construction by the temperature gradients that occur in cooling finger operations.

However, none of the presented proposals has led to an effective solution to the problem. The outer pipe and/or the bottom plate must still be replaced relatively often, with unnecessary high maintenance costs as a result.

Consequently, it is desirable to find an outer pipe bottom construction that will minimize material wear resulting from the temperature gradients that occur in said construction, therewith reducing the maintenance requirements on the gas burner and increasing its length of life.

SUMMARY OF THE INVENTION

The present invention provides such an improved bottom construction for the outer pipe of such a gas burner by including an inner bottom surface which is spaced from the outer pipe surface and against which the through-flowing cooling air is forced to turn back and flow out through the outer tube, whereby the cooling air will never flow in direct contact with the joints between the outer pipe surface and the barrel surface of the outer pipe.

In addition to increasing the useful life of a gas burner, the invention also solves a problem concerning the actual choice of material for construction of the gas burner pipe system. It is desired to use a ferritic material such as FeCrAl in many applications, instead of an austenitic material, such as NiCr. FeCrAl is a better material from the aspect of oxidation and corrosion.

This is because, for instance, FeCrAl is better able to handle decarburization of the material occurring as a result of the differences in carbon potential between the material and the enclosed furnace volume. Such is the case, for instance, when operating burners of the so-called SER type. On the other hand, it is not possible to construct a gas burner according to present technology from a ferritic material, due to the material stresses that occur as a result of the presence of said temperature gradients. Because the present invention is effective in reducing material loads induced by temperature gradients, it is now possible to use ferritic material for the manufacture of gas burners instead of austenitic material.

Thus, the present invention relates to a method in the operation of a burner and/or a cooler in which gases are caused to flow through an inner pipe, out through an outer pipe which surrounds the inner pipe, and back through that part of the outer pipe volume that is not accommodated by the inner pipe volume. The method is characterized by placing an inner bottom plate in the outer pipe in spaced relationship with the closed bottom of the outer pipe, and forcing the gases flowing through the inner pipe and out into the outer pipe to turn and flow back and out between the outer pipe and the inner pipe, thereby creating a thermal insulating gas pocket between the gas and the bottom of the outer pipe.

The present invention also relates to a gas burner/cooler combination.

BRIEF DESCRIPTION OF THE DRAWINGS

The invention will now be described in more detail, partly with reference to the embodiment of the invention shown in the accompanying drawings, in which:

FIG. 3 is an enlarged, fragmentary side view of the lower part of the gas burner, and a view projected from the underside of said burner; and FIG. 4 is an enlarged, fragmentary side view of the lower part of another gas burner embodiment, and a view projected from the underside of said burner.

DESCRIPTION OF THE PREFERRED EMBODIMENTS

Figure 2:
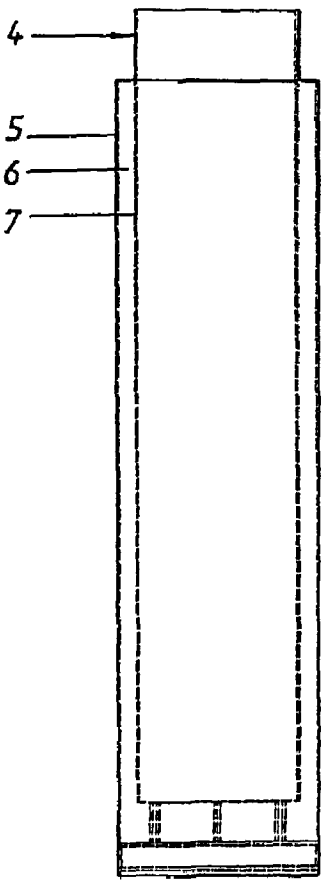
FIG. 2 is a side view of the burner pipe/cooling finger of said burner.
Figure 1:
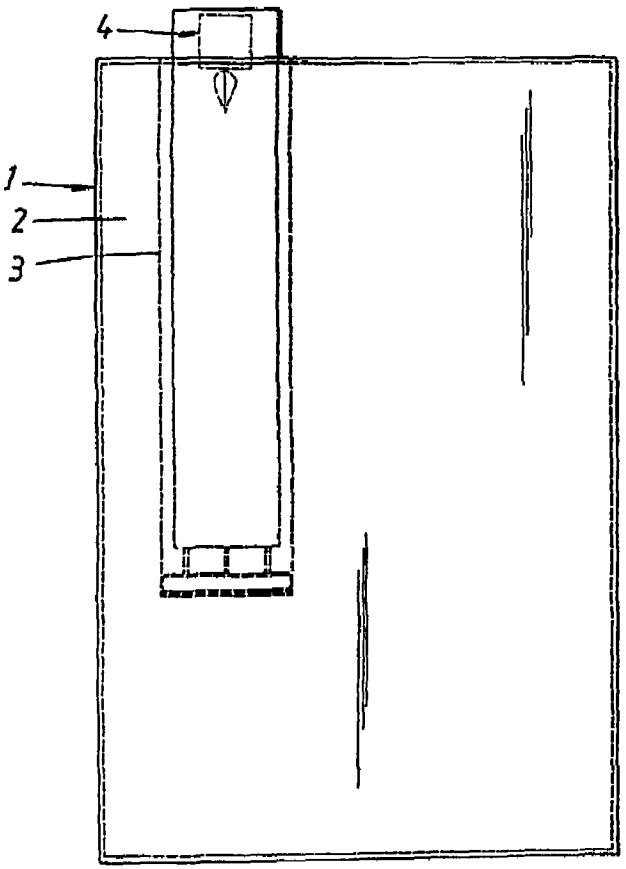
FIG. 1 is an overview of a furnace that includes a gas burner.

FIG. 1 is an overview of a furnace 1 heated by a combined gas burner and cooler 3 constructed in accordance with the invention. FIG. 2 is a side view of said combined gas burner/cooler. The enclosed furnace volume 2 is heated by thermal energy delivered from the gas burner 3. The thermal energy obtained from the gas burner 3 is transmitted to the enclosed furnace volume 2 primarily by thermal radiation, although convection and conduction may also contribute towards heating of the furnace volume.

Gas from an external gas source is ignited in a burner head 4 and the hot, gaseous residual products from the combustion process flow into the inner pipe 7 of the burner and back out through the volume 6 formed between the outer surface of the inner burner pipe 7 and the inner surface of the outer pipe 5.

The gas combustion products will thus never come into contact with the enclosed furnace volume 2.

As indicated above, it is also usual to use cooling air in the same pipe system for cooling purposes. In this case, the gas burner 3 is called a cooling finger instead. Thus, the cold air that flows through the structure when the burner 3 is used as a cooling finger will also not come into contact with the enclosed volume 2 of the furnace.

FIG. 3 illustrates the lower part of the gas burner 3. As will be seen from the figure, a circular inner bottom surface 8 is placed at a distance above the bottom plate 9 of the outer pipe 5. An insert 10 defines the distance between the inner bottom surface 8 and the bottom plate 9 of the outer pipe 5. The insert 10 may be tubular or may be of any other suitable geometric shape. The insert will beneficially have a low heat conductivity and the smallest possible cross-sectional area.

The diameter of the inner bottom plate 8 does not correspond fully to the inner diameter of the outer pipe 5, therewith forming an open gap 11 between the inner bottom surface 8 and the inner surface of the outer pipe 5. This gap ensures that material movements caused by the temperature gradients occurring in operation will not cause mechanical damage to the material, and then particularly to the means with which the bottom plate 9 is secured in the pipe system.

The spacing between the inner bottom plate 8 and the bottom plate 9 of the outer pipe 5 creates an insulating air gap 12. The gases that flow out from the inner pipe 7 and back into the volume 6 between the inner pipe 7 and the outer pipe 5 are obstructed by the upper surface of the bottom plate 8, as a result of which there will be a significant reduction in the effect that the temperature difference existing between the enclosed furnace volume 2 and the gases flowing through the burner 3 has on the volume beneath the inner bottom plate 8. This results in a significant reduction in the extent to which the bottom plate 9 of the outer pipe 5 is heated and cooled, respectively. This, in turn, results in a reduction in the material wear due to material stresses induced by thermal gradients, and also in a significant increase in the useful operating life of the bottom plate 9 of the outer pipe 5.

Located on top of the inner bottom plate 8 is a cruciform spacer 13 which functions partly to define the distance between the inner bottom plate 8 and the bottom edge of the inner pipe 7, and partly to uniformly distribute the gases exiting from the inner pipe 7. The inner pipe 7 rests on the spacer 13. It is important to note that this spacer construction may be any construction whatsoever that will achieve at least one of these two purposes.

Alternatively, the spacer 13 may be omitted, as a result of which those purposes will not be achieved.

It will also be understood that depending on the construction of the remainder of the burner, either the inner bottom plate 8 and the circular insert 10, or the circular insert 10 and the bottom plate 9 of the outer pipe 5, or both of these combinations, can rest loosely on top of each other. Additionally, the insert 10, the inner bottom plate 9, the spacer 13 (when present), and the inner pipe 7 may be joined together mechanically, for instance as by welding, clamping, screwing or in some other appropriate manner. The components may, alternatively, rest loosely one on the other.

FIG. 4 is a view similar to that of FIG. 3 but illustrating another possible embodiment of the invention. In this embodiment, a convection and radiation heat-transfer-reducing insulating material 14 is used instead of the circular insert 10. The insulating material provides still better insulation of the bottom plate 9 of the outer pipe 5, resulting in a still longer length of useful operating life. Moreover, the insulating material 14 also defines the distance between the upper surface of the bottom construction 9 of the outer pipe 5 and the lower surface of the inner bottom plate 8, and it also supports the weight of the inner bottom plate 8 and the components above it.

As will be understood, insulating material 14 may also be used in combination with an insert 10 so as to enhance the load bearing capacity of the construction.

Aluminum silicate fiber is an example of an appropriate insulating material in respect of the present application.

The insert 10 may be metallic or ceramic, or it can be some other suitable material.

It will be obvious that the present invention solves the problems mentioned in the introduction.

Although the invention has been described with reference to a number of embodiments thereof, it will be evident that the design of the structural components can be varied.

The present invention shall not therefore be considered to be limited to the above-described exemplifying embodiments thereof, since variations can be made within the scope of the accompanying claims.

What is claimed is:

1. A method relating to the operation of a thermal unit for heating or cooling the interior of a furnace, said method comprising: flowing gases through an inner pipe out into an outer pipe which has a closed bottom and which surrounds the inner pipe; redirecting the gases that exit the inner pipe back through a volume between the outer pipe and the inner pipe; placing an inner bottom plate in the outer pipe in spaced relationship with the closed bottom of said outer pipe, wherein the inner bottom plate extends across the cross-section of the outer pipe and is substantially perpendicular to the longitudinal axis of the outer pipe to define an insulating gas pocket between the bottom of the outer pipe and the inner bottom plate, whereby gases flowing through the inner pipe and out into the outer pipe impinge against the inner bottom plate and turn to pass between the outer pipe and the inner pipe.

2. A method according to claim 1, wherein the gases are one of hot products of combustion from combustion gas and cooling air.

3. A method according to claim 2, including the step of placing an insulating material between the inner bottom plate and the bottom of the outer pipe.

4. A method according to claim 1, including the step of placing a spacer between the bottom of the outer pipe and the inner bottom plate to support and increase the load bearing capacity of the inner bottom plate.

5. A method according to claim 4, including the step of fastening the spacer mechanically to the bottom of the outer pipe.

6. A method according to claim 4, including the step of fastening the inner bottom plate mechanically to the spacer.

7. A method according to claim 1, including the step of constructing the thermal unit from FeCrAl.

8. A thermal unit for heating or cooling the interior of a furnace, said thermal unit comprising: an inner pipe having an open end; an outer pipe which surrounds and is spaced laterally from the inner pipe and has a closed bottom spaced from the open end of the inner pipe, wherein gases flow through the inner pipe into the outer pipe and back through a space between the outer pipe and the inner pipe; an inner bottom plate located in the outer pipe in spaced relationship with the closed bottom of the outer pipe and between the closed bottom of the outer pipe and the open end of the inner pipe; wherein the bottom plate extends across the cross-section of the outer pipe and is substantially perpendicular to the longitudinal axis of the outer pipe to define an insulating gas pocket between the bottom of the outer pipe and the inner bottom plate.

9. A burner and/or cooler thermal unit according to claim 8, wherein the gases are one of hot products of combustion from combustion gas and cooling air.

10. A thermal unit according to claim 9, including an insulating material between the inner bottom plate and the bottom of the outer pipe.

11. A thermal unit according to claim 8, including a spacer between the bottom of the outer pipe and the inner bottom plate to support and increase the load bearing capacity of the inner bottom plate.

12. A thermal unit according to claim 11, wherein the spacer is fastened mechanically to the bottom of the outer pipe.

13. A thermal unit according to claim 11, wherein the inner bottom plate is fastened mechanically to the spacer.

14. A thermal unit according to claim 8, wherein the thermal unit is formed from FeCrAl.

* * * * *